US007007353B2

(12) United States Patent
Bergkvist

(10) Patent No.: US 7,007,353 B2
(45) Date of Patent: Mar. 7, 2006

(54) BUCKLE DEVICE

(75) Inventor: Håkan Bergkvist, Bromma (SE)

(73) Assignee: Baby Bjorn AB, Danderyd (SE)

( * ) Notice: Subject to any disclaimer, the term of this patent is extended or adjusted under 35 U.S.C. 154(b) by 0 days.

(21) Appl. No.: 10/482,118

(22) PCT Filed: Jun. 18, 2002

(86) PCT No.: PCT/SE02/01177

§ 371 (c)(1),
(2), (4) Date: Dec. 24, 2003

(87) PCT Pub. No.: WO03/003869

PCT Pub. Date: Jan. 16, 2003

(65) Prior Publication Data

US 2005/0071962 A1 Apr. 7, 2005

(30) Foreign Application Priority Data

Jun. 28, 2001 (SE) ..... 0102310

(51) Int. Cl.
*A44B 11/25* (2006.01)

(52) U.S. Cl. ..... 24/657; 24/640; 24/656; 24/658

(58) Field of Classification Search ..... 24/110, 24/115 G, 171, 181, 194–196, 499, 573.1, 24/601.5, 640, 652–658, 634, 635, 671, 702.4, 24/706.7, 706, 707.2, 705, 707.5
See application file for complete search history.

(56) References Cited

U.S. PATENT DOCUMENTS

| | | | | | |
|---|---|---|---|---|---|
| 219,325 | A | * | 9/1879 | Tripp | 24/110 |
| 222,716 | A | * | 12/1879 | Maker | 24/110 |
| 330,152 | A | * | 11/1885 | Walker | 24/110 |
| 417,124 | A | * | 12/1889 | Rammoser | 24/657 |
| 429,089 | A | * | 5/1890 | Esser | 24/110 |
| 1,265,869 | A | * | 5/1918 | Arkin | 24/657 |
| 1,305,979 | A | * | 6/1919 | Cobe | 24/657 |
| 1,380,177 | A | * | 5/1921 | Arkin | 24/657 |
| 1,531,757 | A | * | 3/1925 | Rogers, Jr. | 24/110 |
| 1,565,506 | A | * | 12/1925 | Samuels | 24/110 |
| 4,800,629 | A | | 1/1989 | Ikeda | 24/170 |
| 5,313,691 | A | * | 5/1994 | Hashimoto | 24/69 J |
| 5,970,588 | A | * | 10/1999 | Hurtz et al. | 24/657 |
| 6,557,220 | B1 | * | 5/2003 | Hamm, Jr. | 24/705 |
| 2003/0047573 | A1 | | 3/2003 | Bergkvist | 224/160 |

FOREIGN PATENT DOCUMENTS

| | | |
|---|---|---|
| DK | 15268 C | 11/1911 |
| DK | 24152 | 3/1919 |

(Continued)

*Primary Examiner*—Robert J. Sandy
*Assistant Examiner*—Ruth C. Rodriguez
(74) *Attorney, Agent, or Firm*—Jacobson Holman PLLC

(57) ABSTRACT

A buckle arrangement for releasably connecting two parts of an object that includes a post which projects out at right angles from one part, and a ring-shaped body which is connected to the other part and which is received by the post. The ring-shaped body carries latching shoulders which engage with a waist in the post and which can be released from the post by applying pressure against two exposed press keys connected to the latch shoulders. The buckle arrangement can be used between a lateral end-part of an upper edge-region of a carrier pouch in a child-supporting harness and a chest strap included in the harness, or for mutually connecting the ends of a belt belonging to a babysitter.

14 Claims, 4 Drawing Sheets

FOREIGN PATENT DOCUMENTS

| | | |
|---|---|---|
| EP | 0 956 784 | 11/1999 |
| GB | 1353462 | 5/1974 |
| SE | 344537 | 4/1972 |
| SE | 516 108 | 11/2001 |

* cited by examiner

BUCKLE DEVICE

This is a nationalization of PCT/SE02/01177 filed Jun. 18, 2002 and published in English.

BACKGROUND OF THE INVENTION

1. Field of the Invention

The present invention relates to a buckle arrangement.

2. Description of the Related Art

Known buckle arrangements include those for releasably connecting an object, which include a first buckle part in the form of a post carried by one of the objects, and a second buckle part in the form of a ring-shaped body connected to the other of the object and which receives the post and includes a latch arrangement that enables the ring-shaped body to be latched axially in relation to the post. The ring-shaped body, as latched to the post, can be rotated around the post. Buckle arrangements of this kind are known to the art in respect of certain kinds of use.

SUMMARY OF THE INVENTION

One object of the present invention is to provide a novel design of a buckle arrangement which enables buckling and unbuckling of the two main parts of said arrangement to be readily achieved with one hand, which ensures secure connection between said parts, which enables one flat ring-shaped buckle part to be effectively coupled to the other buckle part, this other part having the form of a post in both possible coupling positions, and which cannot be readily opened by children.

A further object of the invention is to provide a buckle arrangement for use with child supporting safety harnesses, babysitters and other constructions of a similar nature with which it is desirable to achieve the aforesaid objects and other favourable effects.

A further object is to provide a buckle arrangement, which is favourable from the aspect of manufacture and assembly. Another object is to provide a buckle or coupling arrangement design with which the buckle parts are pre-fitted to a flexible connecting element, such as straps or the like, which can, in turn, be readily connected to an article, for instance sewn securely thereto.

Another object of the invention is to provide embodiments of the buckle arrangement where one buckle part is supplemented with adjusting means that are intended to be fastened to the article concerned in conjunction with connecting the buckle part to said article, and where one end-part of the adjusting device can be connected to one of the buckle parts.

These objects are achieved by the invention, either totally or partially.

The present invention is directed to a buckle arrangement for releasably connecting two objects, including a first buckle part in the form of a post which is carried by one of the objects, and a second buckle part in the form of a ring-shaped body which is connected to the other of the objects and which has an opening that receives the post. The post has a waist and a free end part that narrows toward its free end. The ring-shaped body includes a latch arrangement that grips in the waist under the influence of a tensioning device to enable the ring-shaped body to be latched axially in relation to the post and rotated thereabout. More particularly, the latch arrangement includes two latch elements which each include a latch shoulder and a press key that is exposed on the outside of the ring-shaped body. The latch elements are mutually spring-biased so as to bring the latch shoulder into engagement with mutually opposite sides of a waist in the post, with the latch elements being formed to allow the latch shoulders to move free from the waist when the press keys are pressed diametrically towards each other.

In one particularly preferred embodiment of the invention, the latching device may include two latching elements each having a latching shoulder that can engage the waist, and a press key which is exposed on the outside of the ring-shaped body, wherein when brought together simultaneously said keys function to move the latching shoulders apart against the action of spring means, such as to cause the latching shoulders to move out of engagement with said waist and permit the ring-shaped body to be withdrawn from the post. The ring-shaped body is conveniently arranged to rotate about the post. The free end of the post provides a wedging effect, so as to enable the latching elements to be returned against their spring bias as the ring-shaped body is threaded onto the post.

The present invention may be more particularly embodied such that the ring-shaped body includes a ring-shaped housing that has a diametrical through-passing channel that extends perpendicular to the ring opening axis of the ring-shaped body. The two latch elements can have the form of two mutually identical ring-shaped elements, in which the press key and the lock shoulder are located in diametrically opposite positions in relation to the opening in the latch element, and having an integral spring. The latch elements are parallel and brought together in mutually opposite directions with the ring openings in general alignment. The spring belonging to one element supports against the radially inner side of the press key of the other element, and vice versa, with the latch elements that are brought together having a cross-section that corresponds to the cross-section of the through-passing channel. Latch structures provided on the latch elements and the housing function to retain the latch elements in the housing when secured therein.

According to a further embodiment, the channel in the housing has a generally rectangular cross-section and includes midway along its length a wall opening which functions to receive projections on the latch elements. The channel wall of the housing is elastically flexible outwardly to provide room for the projections when the latch elements are inserted together in the channel.

The housing may further include an outwardly projecting tongue that includes a slot-like opening for the anchoring end of a strap whose other endpart extends through an adjustment fitting.

Also according to the present invention, the waist on the post can have a generally right-angled U-profile, with the latch shoulders having generally parallel end-surfaces which co-act with the legs of such profile.

The buckle parts of the post and the ring-shaped body according to the present invention may be fitted to the ends of a waist belt, or between a chest strap of a child support harness and the lateral end-part of an upper edge region of a front piece which, together with the harness, form a child-carrying pouch therein.

The buckle arrangement may be used conveniently between a lateral end of an upper edge region of a front piece and a chest strap of a child support harness of the kind disclosed in SE 0001700-4, by way of example, such that the post will project forwards on the outside of the chest strap. The following advantages are among those that are afforded in this way:

Rotatability of the ring-shaped body around the post minimises the stresses in the buckle arrangement and in the parts of the harness connected thereto.

The shape-bound latching of the ring-shaped body to the post constitutes an essential safety facility that is particularly important with regard to a child supporting harness.

The ring-shaped body can be turned through 180° about a horizontal ring diameter and can be coupled equally securely to the post in both of its rotational positions, which is favourable in view of the fact that the upper foldable part of the front piece should be capable of being connected to the chest strap in both the lowered and raised position of the upper edge region.

The ring-shaped body is non-rotatably connected to the post with respect to rotation about a horizontal axis in the plane of the front piece, which is important when the ring-shaped body is, in turn, non-rotatably connected to the upper elastically foldable edge region of the front piece, since such rotational rigidity contributes towards keeping the upper edge region of the front piece in its downwardly folded position, despite the propensity of the upper edge region to rise due to its elasticity.

The user is able to buckle-up the buckle arrangement readily with one hand, for example by placing the thumb of the adjacent hand behind the chest strap, beneath the post, while pressing the ring down over the post with the index finger and long finger of the same hand, or by pressing the ring down onto the post when the post is mounted on a stable underlying support surface.

The user can readily unbuckle the buckle arrangement by manipulating the mutually opposing latching keys on the ring-shaped body with the thumb and index finger of said adjacent hand.

The buckle arrangement produces a clear acoustic signal when the latching elements of the ring-shaped body snap into the waist on the post as the spring is tensioned.

The buckle arrangement can be designed so that the latching elements of the ring will snap into the waist on said post essentially when the ring-shaped body reaches contact with a stop abutment at the bottom of the post, in both orientations of the ring-shaped body on the post, said positions being mutually separated through an angle of 180°.

The buckle arrangement can also be used conveniently between strap or belt ends that shall be detachably connected to each other, for instance in the case of a babysitter.

DETAILED DESCRIPTION OF THE PREFERRED EMBODIMENTS

Figure 1:
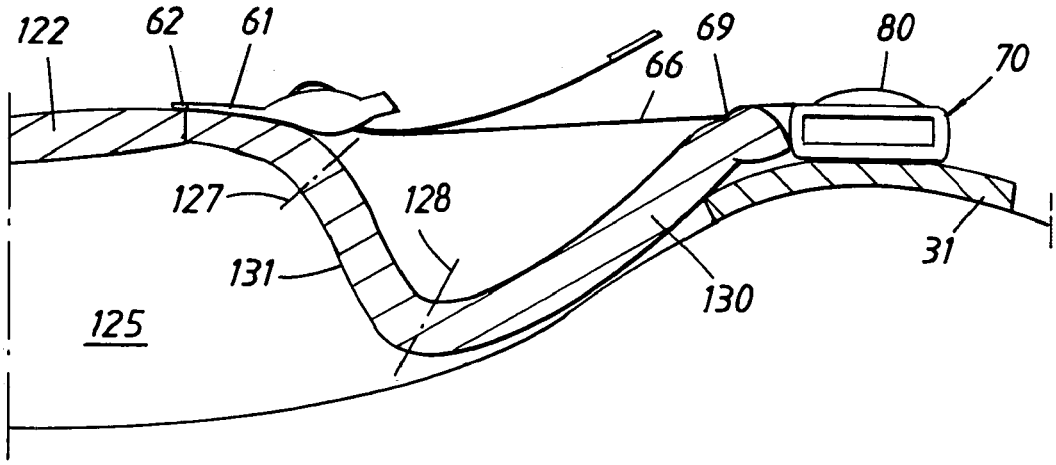
FIG. 1 is a schematic side view of an inventive buckle arrangement as fitted between a generally vertically orientated chest strap and a lateral upper end-region of a front piece of a child supporting harness.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

A child support harness of the kind disclosed in SE 0001700-4 for example, includes an harness arrangement, which carries a flexible sheet-like front piece that is adapted to form a child-carrying pouch. The front piece 22 includes an upper edge region 122 which can be dropped down towards and raised from the lower part of said front piece (said lower part forming the actual pouch) via a horizontal fold line 124. The front piece 22 has lateral openings 123 on the level of the fold line 124. The upper edge region 122 can be dropped down, when the child is awake.

When a child wishes to rest or to sleep, the upper edge region 122 can be raised and its lateral ends 125 coupled to adjacent parts of the harness chest straps 31, with the aid of a releasable buckle arrangement, one part 70 of which is connected to the apex of the part 125 and the other part 80 of which is connected to a chest strap 31.

The edge region 122 is flexible, at least at said lateral end-parts 125 and also with respect to folding about the fold line 124. The buckle parts 70, 80 co-act with the edge region 122 so as to form a head support for a small and/or sleeping child.

Figure 2:
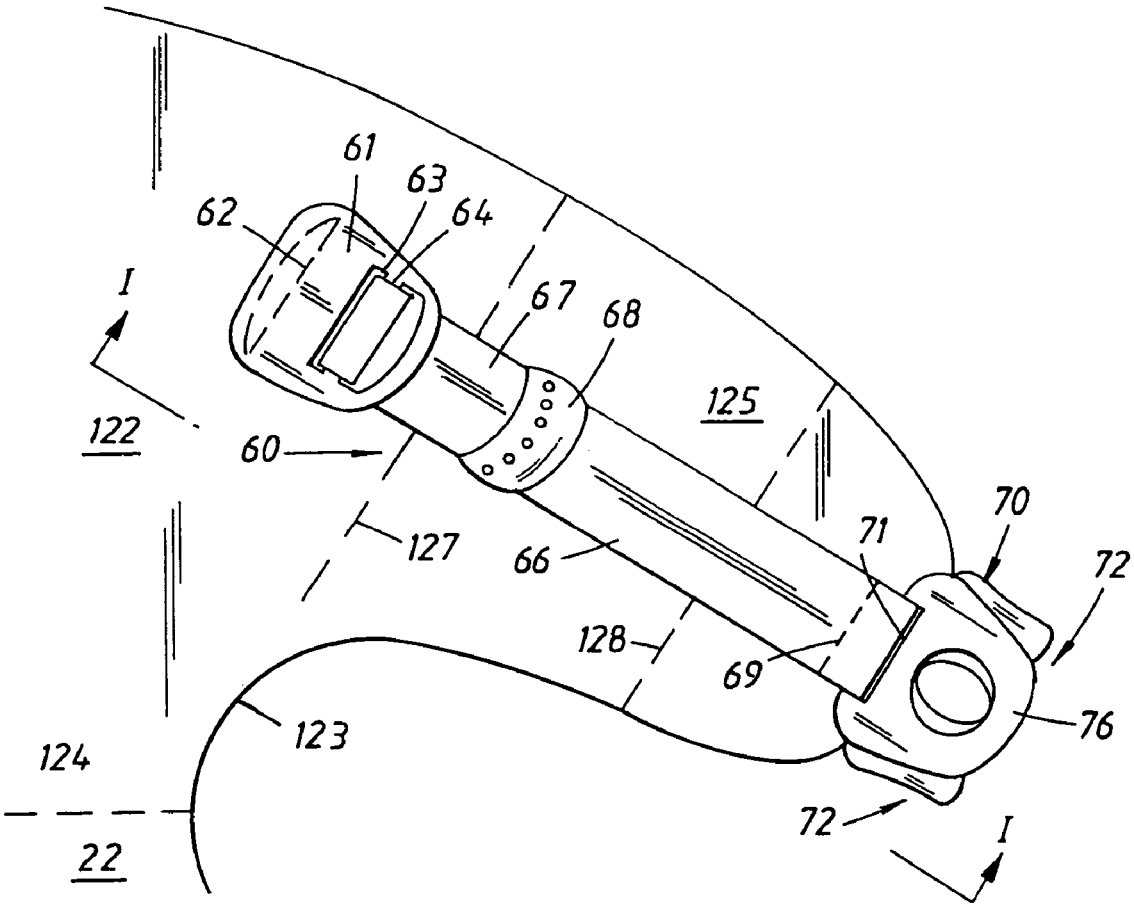
FIG. 2 is a schematic view taken on the line II—II in FIG. 1.

FIG. 2 shows that the first part 70 of the buckle arrangement is non-rotatably connected to the lateral apex portion 125 of the portion 122 with the aid of a seam 69 through one end-part of a strap 66 that extends through a slot-like opening 71 in the sewing tongue 181 of the buckle part 70, said seam 69 suitably extending through both parts of the end-portion of the strap 66 and the front piece.

Roughly midway to the symmetry line of the front piece 22 there is an anchor fitting 61 which is connected to the portion 122 by means of a seam 62. The fitting 61 has two through-passing openings 63, which are delimited from each other by a post 64. The free end-part of the strap 66 passes through the openings 63 and around the post. The free end 67 of the strap is shown to include a finger grip 68, which also prevents the strap from being drawn through the openings 63 in the fitting 61. The fitting 61 co-acts with the strap 66 in a known manner, wherein the effective length of the strap 66 between the post 64 and the seam 69 can be adjusted by pulling in the strap end 67 and lifting up the fitting 61 around the seam 62, so as to enable the strap 66 to slide out of the fitting 61.

The strap 66 is orientated generally horizontally.

It will be seen from FIG. 2 that the strap arrangement 60 enables the distance between the part 70 of the buckle arrangement and the fitting 61 to be selectively adjusted, wherewith the part 125 will bend naturally in the configuration shown in FIG. 2, partly about a generally vertical fold line 127 in the proximity of the seam 62, and partly in a length-wise midway portion 128. The part 130 between the seam 69 and the fold 128 lies against the chest of the wearer, and the part 131 between the fold lines 127, 128 retains a generally flat state whose angle to the surface of the wearer's chest varies with the effective length of the strap 66. The part 131 forms a comfortable support surface for the child's head. This arrangement also avoids the wedging effect to which the child's head would otherwise be subjected.

As will be understood, bending indications/fold lines 127, 128 can be provided in the front piece, to ensure that it will bend at the places indicated.

It will be seen that the strap arrangement 60 is accessible and manoeuvrable even when the upper edge region 122 is dropped down against the lower part of the front piece 22, so as to enable the size of the upwardly facing opening of the support pouch to be adjusted when so desired.

According to one particularly preferred embodiment of the invention, the part 70 of the buckle arrangement is of the known kind that includes a ring-shaped flat buckle element 70 which can be releasably connected by threading it around a post 80.

This embodiment enables the buckle part 70 to be connected to the post 80 in two positions of rotation spaced 180° apart about a rotational axis that corresponds to a generally horizontal diameter through the opening of the buckle part 70. The buckle part 70 is fitted so as to lie in the proximity of the fold line 124 through the flat-lain front piece 22. Because the buckle part 70 is non-rotatably connected to the apex portion 125, the buckle arrangement 70, 80 contributes in keeping the edge region 122 in its down-folded state, about the line 124. The flexible, elastic front piece 22 has a tendency to allow the upper edge region 122 to remain raised in the FIG. 1 position, due to the intrinsic elasticity of said front piece.

Figure 5:
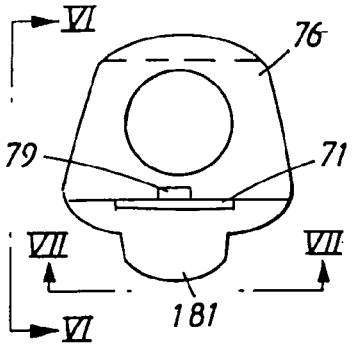
FIG. 5 is a side view of the housing of a first part of the buckle arrangement.
Figure 6:
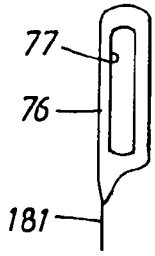
FIG. 6 is a view taken on the line VI—VI in FIG. 5.
Figure 7:
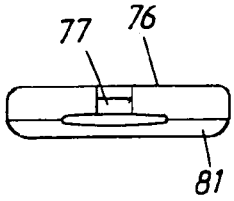
FIG. 7 is a view taken on the line VII—VII in FIG. 5.
Figure 8:
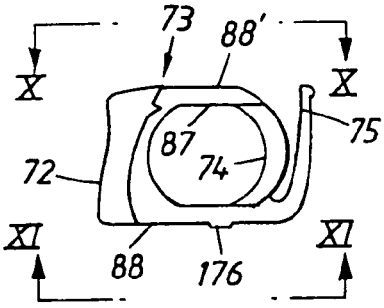
FIGS. 8 and 9 illustrate opposite plan views of a latching element in the first part of the buckle arrangement.
Figure 9:
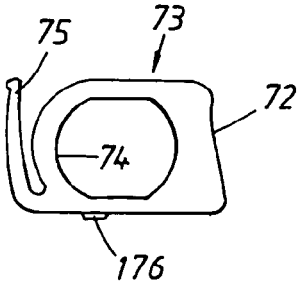
Figure 10:
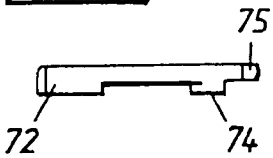
FIGS. 10 and 11 are views taken on the line X and XI respectively in FIG. 8.
Figure 11:
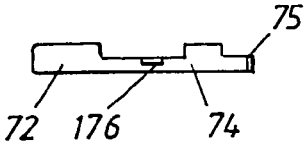
Figure 12:
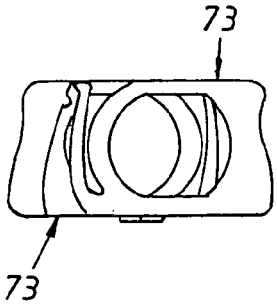
FIG. 12 shows two latching elements according to FIGS. 8–11 prior to their insertion into the housing shown in FIGS. 5–7.

In one particularly preferred embodiment of the buckle part 70, said part comprises a generally tubular housing 76, according to FIGS. 5–7, which receives two mutually identical carrier elements 73, according to FIGS. 8–11, which are brought together into a configuration according to FIG. 12 prior to the pair of latching elements 73 being inserted into the housing 76 to form the completed buckle part 70, as shown in FIG. 2.

Each element 73 has the general form of a thin, flat plate having an opening 87, and includes two generally parallel, mutually opposite edges 88, 88'. Located between these edges on opposite sides of the opening 87 is a broadening of the plate or disk so as to form a press key 72 and a latching shoulder 74 respectively, which define a limitation of the opening 87. The element also has a spring leg 75 which lies in the plane of said plate and extends generally at right angles out from one edge 88 in a direction towards the other edge 88'.

The element 73 is assumed to be comprised of a springy, elastic material, for example a plastic material.

Latch shoulders 176 project out from the edge 88.

The housing 76 includes in its bottom adjacent the slot 71, a wall opening 79 which receives the latch shoulders 176 when the pair of elements 73, in the configuration according to FIG. 12, are inserted in the through-passing channel 77 of the housing 76.

The post 80 includes a relatively wide bottom plate 83 which forms an end stop for one major surface of the buckle part 70 when the buckle part is threaded over the post 80. The post 80 is preferably rotationally-symmetrical in an axis which is perpendicular to the plane of the chest strap 31, and the post 80 has a waist part 82 and a conical free-end 81 which is able to co-act with the carrier elements 73 such as to move them apart.

The waist 82 is delimited by two parallel ring surfaces. When the buckle part 70 is threaded down on the post 80, the latch shoulders 74 will snap audibly into the waist 82 and provide a shape-fixture against withdrawal of the part 70. The latch shoulders 74 of the buckle part 70 are released from the waist, by pressing the two exposed press keys 72 simultaneously towards each other and into the housing channel 77, for instance with the thumb and index finger of the operating hand. The user can press the ring-shaped buckle part 70 onto the post, by holding his/her thumb under the post 80, beneath the strap or belt 31, and pulling down the buckle part 70 onto the post with his/her index finger and middle finger. The stop abutment plate 83 and its distance from the waist 82 enhance the certainty of the buckle part 70 securely gripping the waist 82 on the post when said part 70 is fully threaded on the post 80 and into contact with said stop abutment plate 83.

Figure 3:
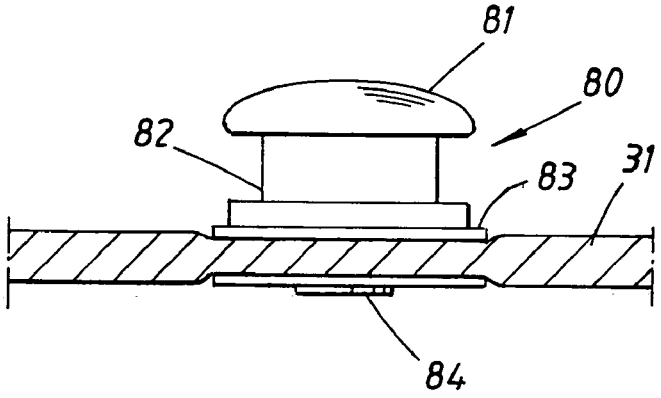
FIG. 3 is a schematic side view of a part of the buckle arrangement in the form of a post.

As shown in FIG. 3, the post 80 is anchored to the strap 31 by means of a riveting device 84 or the like.

The post may be mounted so as to project perpendicularly from a flexible piece of material, such as a strap or belt, and the ring-shaped body may be secured to a flexible piece of material, such as a belt or strap. The buckle parts may thus be prefitted to the ends 31', 125' of a waist belt or lap belt of the type illustrated in FIG. 4.

Figure 4:
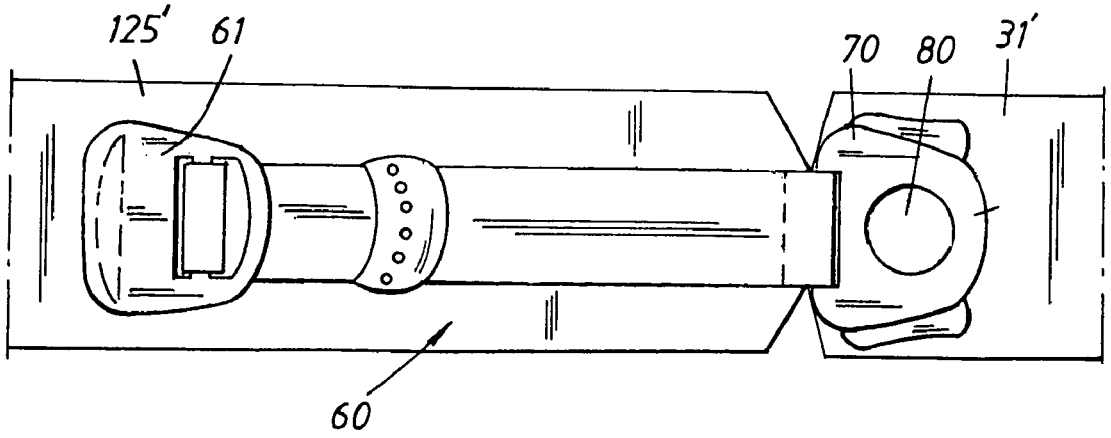
FIG. 4 is a plan view of the buckle arrangement as fitted to an openable waist belt.

It will also be seen from FIG. 4 that one part of a belt-end may be provided with a strap arrangement 60 of the afore-described kind, one end of which may conveniently be connected directly to one buckle part and the other end-portion of which can be connected to the belt at a distance from said end-part, for adjustment to the effective perimeter of the waist belt.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A buckle arrangement for releasably connecting first and second parts of an object comprising:

a first buckle part including a post which is carried by said first object part, said post having a waist;

a second buckle part including a ring-shaped body which is connected to the second object part, said ring-shaped body having a housing with a diametrical through-passing channel that extends perpendicular to a ring opening axis of said ring-shaped body;

said second buckle part including a latch arrangement that enables the ring-shaped body to be latched axially in relation to the post, said latch arrangement having two mutually identical, ring-shaped latch elements each with a respective opening therein, each latch element including a latch shoulder, a press key and an integral spring, the latch elements being parallel and brought in mutually opposite directions with the respective openings thereof in general alignment such that a cross-section of said two latch elements corresponds to a cross-section of said channel, said press keys being exposed on an outside of the ring-shaped body and located in diametrically opposite positions in relation to said openings with the spring of one latch element supporting against a radially inner side of the press key of the other latch element, and vice versa, said springs biasing said latch elements so as to bring the latch shoulders into engagement with mutually opposite sides of said waist and allowing the latch shoulders to move free from the waist when the press keys are pressed diametrically towards each other.

2. The buckle arrangement according to claim 1, wherein the ring-shaped body has two mutually opposite and parallel end surfaces whose normal defines said ring opening axis, an insertion end of the post having a stop surface for co-action with the ring-shaped body, at least one surface of the ring-shaped body lying against the stop surface when the latch shoulders engage said waist.

3. The buckle arrangement according to claim 1, wherein said channel in said housing has a generally rectangular cross-section and includes midway along a length thereof a wall opening to receive projections on said latch elements, said wall being elastically flexible to provide room for said projections when the latch elements are inserted together in said channel.

4. The buckle arrangement according to claim 1, wherein said housing includes a sewing tongue.

5. The buckle arrangement according to claim 1, wherein said housing includes an outwardly projecting tongue that includes a slot-like opening for an anchoring end of a strap, a distal end-part of said strap extending through an adjustment fitting.

6. The buckle arrangement according to claim 1, wherein the waist on the post has a generally right-angled U-profile, said latch shoulders having generally parallel end-surfaces which co-act with legs of said profile.

7. The buckle arrangement according to claim 1, wherein the buckle parts are fitted to ends of a waist belt.

8. The buckle arrangement according to claim 1, wherein said latch elements and said ring-shaped housing include complementary latch structures to retain said latch elements within said housing.

9. A combination of an object having a waist belt and buckle arrangement for releasably connecting first and second parts of the object comprising:

a first buckle part including a post which is carried by said first object part, said post having a waist;

a second buckle part including a ring-shaped body which is connected to the second object part, said ring-shaped body, as latched to the post, being rotatable therearound;

said second buckle part including a latch arrangement that enables the ring-shaped body to be latched axially in relation to the post and having two latch elements, each latch element including a latch shoulder and a press key that is exposed on an outside of the ring-shaped body, the latch elements being mutually spring-biased so as to bring the latch shoulders into engagement with mutually opposite sides of said post waist, said latch elements allowing the latch shoulders to move free from the waist when the press keys are pressed diametrically towards each other; and said first and second buckle parts being fitted to said first and second object parts at respective ends of the waist belt.

10. The buckle arrangement according to claim 9, wherein the ring-shaped body has two mutually opposite and parallel end surfaces whose normal defines a ring opening axis, an insertion end of the post having a stop surface for co-action with the ring-shaped body, at least one surface of the ring-shaped body lying against the stop surface when the latch shoulders engage said waist.

11. The buckle arrangement according to claim 9, wherein said ring-shaped body includes a housing with a channel having a generally rectangular cross-section, a wall of said channel including along a length thereof a wall opening to receive projections on said latch elements, said wall being elastically flexible to provide room for said projections when the latch elements are inserted together in said channel.

12. The buckle arrangement according to claim 9, wherein said ring-shaped body includes a housing having an outwardly projecting tongue with a slot-like opening for an anchoring end of a strap.

13. The buckle arrangement according to claim 12, wherein said latch elements and said ring-shaped housing include complementary latch structures to retain said latch elements within said housing.

14. The buckle arrangement according to claim 9, wherein the waist on the post has a generally right-angled U-profile, said latch shoulders having generally parallel end-surfaces which co-act with legs of said profile.

* * * * *